US008866733B2

(12) United States Patent
Markvoort et al.

(10) Patent No.: US 8,866,733 B2
(45) Date of Patent: Oct. 21, 2014

(54) SEQUENTIAL ADDRESSING OF DISPLAYS

(71) Applicant: Creator Technology B. V., Breda (NL)

(72) Inventors: Wieger Markvoort, Eindhoven (NL); Hjalmar Edzer Ayco Huitema, Veldhoven (NL); Leendert Mark Hage, Eindhoven (NL)

(73) Assignee: Creator Technology B.V., Breda (NL)

( * ) Notice: Subject to any disclaimer, the term of this patent is extended or adjusted under 35 U.S.C. 154(b) by 0 days.

(21) Appl. No.: 14/069,241

(22) Filed: Oct. 31, 2013

(65) Prior Publication Data

US 2014/0062991 A1 Mar. 6, 2014

Related U.S. Application Data

(63) Continuation of application No. 12/513,323, filed as application No. PCT/NL2007/050527 on Nov. 2, 2007, now Pat. No. 8,599,128.

(60) Provisional application No. 60/865,018, filed on Nov. 9, 2006, provisional application No. 60/864,202, filed on Nov. 3, 2006.

(51) Int. Cl.
*G09G 3/34* (2006.01)
*G09G 3/36* (2006.01)

(52) U.S. Cl.
CPC ..... *G09G 3/344* (2013.01); *G09G 3/3655* (2013.01); *G09G 2330/021* (2013.01); *G09G 2300/043* (2013.01); *G09G 2300/0876* (2013.01)
USPC ..... 345/107; 359/296

(58) Field of Classification Search
USPC ..... 345/87, 107, 204, 691; 359/296
See application file for complete search history.

(56) References Cited

U.S. PATENT DOCUMENTS

| | | | | |
|---|---|---|---|---|
| 6,956,557 | B2 * | 10/2005 | Machida et al. | 345/107 |
| 6,987,502 | B1 * | 1/2006 | Kishi et al. | 345/107 |
| 7,639,221 | B2 * | 12/2009 | Aoki | 345/87 |
| 8,130,186 | B2 * | 3/2012 | Jones | 345/87 |
| 8,599,128 | B2 * | 12/2013 | Markvoort et al. | 345/107 |

* cited by examiner

*Primary Examiner* — Abbas Abdulselam

(57) ABSTRACT

A display device includes a row driver configured to provide a row voltage, and a row electrode connected to the row driver. A column driver is configured to provide a column voltage to a column electrode. Further, a common driver is configured to provide a common electrode that includes a negative level. In addition, a controller is configured to switch the common electrode between at least two levels when all rows have a non-select level of the row voltage. The controller may be further configured to switch the common electrode at a substantially same time and with a substantially same voltage swing as a storage voltage of a storage capacitor.

12 Claims, 9 Drawing Sheets

SEQUENTIAL ADDRESSING OF DISPLAYS

This Application is a continuation of U.S. application Ser. No. 12/513,323, having an 371(c) date of Jul. 1, 2010, which is a National Stage Entry of PCT/NL07/50527, filed on Nov. 2, 2007, which claims the benefit of U.S. provisional Application No. 60/864,202, filed on Nov. 3, 2006, and U.S. provisional Application No. 60/865,018, filed on Nov. 9, 2006, the entirety of which are incorporated by reference herein.

TECHNICAL FIELD

The present invention relates to display devices, such as color sequential addressing of electrophoretic display devices provided with variable voltage levels.

BACKGROUND

Displays, such as liquid crystal (LC) and electrophoretic displays include particles suspended in a medium sandwiched between a drive or pixel electrode and a common electrode. The pixel electrode includes pixel drivers, such as an array of thin film transistors (TFTs) that are controlled to switch on and off to form an image on the display. The voltage difference ($V_{DE}=V_{Eink}=V_{CE}-V_{px}$ as shown in FIGS. 3 and 5A) between a TFT(s) or the pixel electrode(s) and the common electrode, which is on the viewer's side of the display, causes migration of the suspended particles, thus forming the image. Displays with an array of individually controlled TFTs or pixels are referred to as active-matrix displays.

In order to change image content on an electrophoretic display, such as from E Ink Corporation for example, new image information is written for a certain amount of time, such as 500 ms to 1000 ms. As the refresh rate of the active-matrix is usually higher, this results in addressing the same image content during a number of frames, such as at a frame rate of 50 Hz, 25 to 50 frames. Circuitry to drive displays, as well as electrophoretic displays, are well known, such as described in U.S. Pat. No. 5,617,111 to Saitoh, International Publication No. WO 2005/034075 to Johnson, International Publication No. WO 2005/055187 to Shikina, U.S. Pat. No. 6,906,851 to Yuasa, and U.S. Patent Application Publication No. 2005/0179852 to Kawai, each of which is incorporated herein by reference in its entirety.

FIG. 1 shows a schematic representation 100 of the E-ink principle, where different color particles, such as black micro-particles 110 and white micro-particles 120 suspended in a medium 130, are encapsulated by the wall of an E-ink capsule 140. Typically, the E-ink capsule 140 has a diameter of approximately 200 microns. A voltage source 150 is connected across a pixel electrode 160 and a common electrode 170 located on the side of the display viewed by a viewer 180. The voltage on the pixel electrode 160 is referred to as the pixel voltage $V_{px}$, while the voltage on the common electrode 170 is referred to as the common electrode voltage $V_{CE}$. The voltage across the pixel or capsule 140, i.e., the difference between the common electrode and pixel voltages, is shown in FIG. 5A as $V_{Eink}$.

Addressing of the E-ink 140 from black to white, for example, requires a pixel represented as a display effect or pixel capacitor $C_{DE}$ in FIGS. 3 and 5A and connected between pixel electrodes 160 and a common electrode 170, to be charged to −15V during 500 ms to 1000 ms. That is, the pixel voltage $V_{px}$ at the pixel electrode 160 (also shown in FIG. 5A as the voltage at node P) is charged to −15V, and $V_{Eink}=V_{CE}-V_{px}=0-(-15)=+15V$. During this time, the white particles 120 drift towards the top common electrode 170, while the black particles 110 drift towards the bottom (active-matrix, e.g., TFT, back plane) pixel electrode 160, also referred to as the pixel pad.

Switching to a black screen, where the black particles 110 move towards the common electrode 170, requires a positive pixel voltage $V_{px}$ the pixel electrode 160 with respect to the common electrode voltage $V_{CE}$. In the case where $V_{CE}=0V$ and $V_{px}=+15V$, the voltage across the pixel ($C_{DE}$ in FIG. 5A) is $V_{Eink}=V_{CE}-V_{px}=0-(+15)=-15V$. When the voltage across the pixel $V_{Eink}$ is 0V, such as when both the pixel voltage $V_{px}$ at the pixel electrode 160 and the common electrode voltage $V_{CE}$ are 0V ($V_{px}$=VcE=0), then the E-ink particles 110. 120 do not switch or move. As shown in the graph 200 of FIG. 2, the switching time of the E-ink 140 (or $C_{DE}$ in FIGS. 3 and 5A) to switch between the black and white states decreases (i.e., the switching speed increases or is faster) with increasing voltage across the pixel $V_{DE}$ or $V_{Eink}$. The graph 200, which shows the voltage across the pixel $V_{Eink}$ on the y-axis in volts versus time in seconds, applies similarly to both switching from 95% black to 95% white screen state, and vice verse. It should be noted that the switching time decreases by more than a factor two when the drive voltage is doubled. The switching speed therefore increases super-linear with the applied drive voltage.

FIG. 3 shows the equivalent circuit 300 for driving a pixel (e.g., capsule 140 in FIG. 1) in an active-matrix display that includes a matrix or array 400 of cells that include one transistor 310 per cell or pixel (e.g., pixel capacitor $C_{DE}$) as shown in FIG. 4. A row of pixels is selected by applying the appropriate select voltage to the select line or row electrode 320 connecting the TFT gates for that row of pixels. When a row of pixels is selected, a desired voltage may be applied to each pixel via its data line or the column electrode 330. When a pixel is selected, it is desired to apply a given voltage to that pixel alone and not to any non-selected pixels. The non-selected pixels should be sufficiently isolated from the voltages circulating through the array for the selected pixels. External controller(s) and drive circuitry is also connected to the cell matrix 400. The external circuits may be connected to the cell matrix 400 by flex-printed circuit board connections, elastomeric interconnects, tape-automated bonding, chip-on-glass, chip-on-plastic and other suitable technologies. Of course, the controllers and drive circuitry may also be integrated with the active matrix itself.

In FIG. 4, the common electrodes 170 are connected to ground instead of a voltage source that provide $V_{CE}$. The transistors 310 may be TFTs, for example, which may be MOSFET transistors 310, as shown in FIG. 3, and are controlled to turn ON/OFF (i.e., switch between a conductive state, where current Id flows between the source S and drain D, and non-conductive state) by voltage levels applied to row electrodes 320 connected to their gates G, referred to as $V_{row}$ or $V_{gate}$. The sources S of the TFTs 310 are connected to column electrodes 330 where data or image voltage levels, also referred to as the column voltage $V_{col}$ are applied.

As shown in FIG. 3, various capacitors are connected to the drain of the TFT 310, namely, the display effect capacitor $C_{DE}$ that contains the display effect also referred to as the pixel capacitor, and a gate-drain parasitic capacitor $C_{gd}$ between the TFT gate G and drain D shown in dashed lines in FIG. 3. In order to hold the charge or maintain the level of pixel voltage $V_{px}$ (at node P to remain close to the level of the column voltage $V_{col}$) between two select or TFT-ON states (as shown by reference numeral 765 in FIG. 7), a storage capacitor $C_{st}$ may be provided between the TFT drain D and a storage capacitor line 340. Instead of the separate storage capacitor line 340, it is also possible to use the next or the previous row electrode as the storage capacitor line.

Conventional active matrix E-ink displays suffer from various drawbacks. One drawback is that power consumption during an image update is relatively large, due to the relatively high voltages that must be applied during addressing of the display. A straightforward solution would be lowering the addressing voltages. However, the disadvantage of the lower voltage levels is that the image update time increases more than linear with the voltage reduction as shown in FIG. 2, leading to very long image update times (i.e., slower image updates). Another drawback is that the image update time of E-ink is relatively long despite the high voltage levels. Accordingly, there is a need for better displays, such as displays with decreased image update time without an increase in the addressing voltage and thus without an increase of power consumption.

SUMMARY

One object of the present devices and methods is to overcome the disadvantage of conventional displays.

This and other objects are achieved by methods display devices comprising a row driver configured to provide a row voltage, and a row electrode connected to the row driver. A column driver s configured to provide a column voltage to a column electrode. Further, a common driver is configured to provide a common electrode with a positive common voltage level for a first state and a negative common voltage level for a second state. Of course, it should be understood that more than two levels may be used for the common voltage applied to the common electrode. In addition, a controller may be configured to switch the common electrode between at least two levels when all rows have a non-select level of the row voltage. Alternatively the Vce and Vst are switched at substantially the same time: (1) when no rows are selected; or (2) at the start of any row selection time; or (3) during a row selection time after which the selected row gets at least a full row selection period to charge the pixels to the column voltage level. In particular, preferably the switch of the Vce and the Vst does not result in one or more pixels being charged to an incorrect voltage (i.e. another voltage than the column voltage). The controller may be further configured to switch the common electrode at a substantially same time and with a substantially same voltage swing as a storage voltage of a storage capacitor.

By varying the common voltage and the storage voltage of the storage capacitor at substantially the same time and by an amount substantially related to the ratio of the storage capacitance and the total capacitance, the display effect or image formed by the pixel is maintained with minimal disturbance, yet various advantages may be achieved such as faster image update speed or reduced image update time, reduced column and/or row voltage levels, reduced power consumption, as well as improved image uniformity.

Further areas of applicability of the present systems and methods will become apparent from the detailed description provided hereinafter. It should be understood that the detailed description and specific examples, while indicating exemplary embodiments of the displays and methods, are intended for purposes of illustration only and are not intended to limit the scope of the invention.

BRIEF DESCRIPTION OF THE DRAWINGS

These and other features, aspects, and advantages of the apparatus, systems and methods of the present invention will become better understood from the following description, appended claims, and accompanying drawing where:

DETAILED DESCRIPTION

The following description of certain exemplary embodiments is merely exemplary in nature and is in no way intended to limit the invention, its application, or uses. In the following detailed description of embodiments of the present systems, devices and methods, reference is made to the accompanying drawings which form a part hereof, and in which are shown by way of illustration specific embodiments in which the described devices and methods may be practiced. These embodiments are described in sufficient detail to enable those skilled in the art to practice the presently disclosed systems and methods, and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with the exception that identical components which appear in multiple figures are identified by the same reference numbers. Moreover, for the purpose of clarity, detailed descriptions of well-known devices, circuits, and methods are omitted so as not to obscure the description of the present system.

Figure 3:
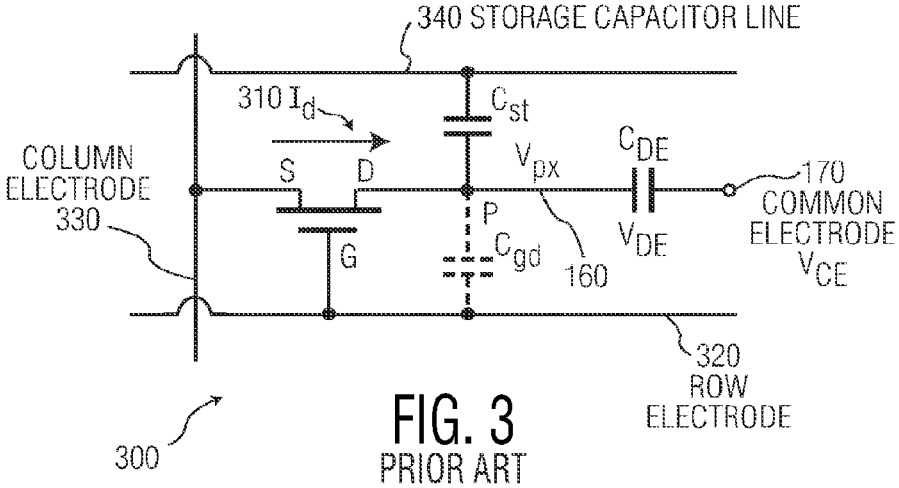
FIG. 3 PRIOR ART
FIG. 3 shows the equivalent circuit of a pixel in a conventional active-matrix display.
Figure 5A:
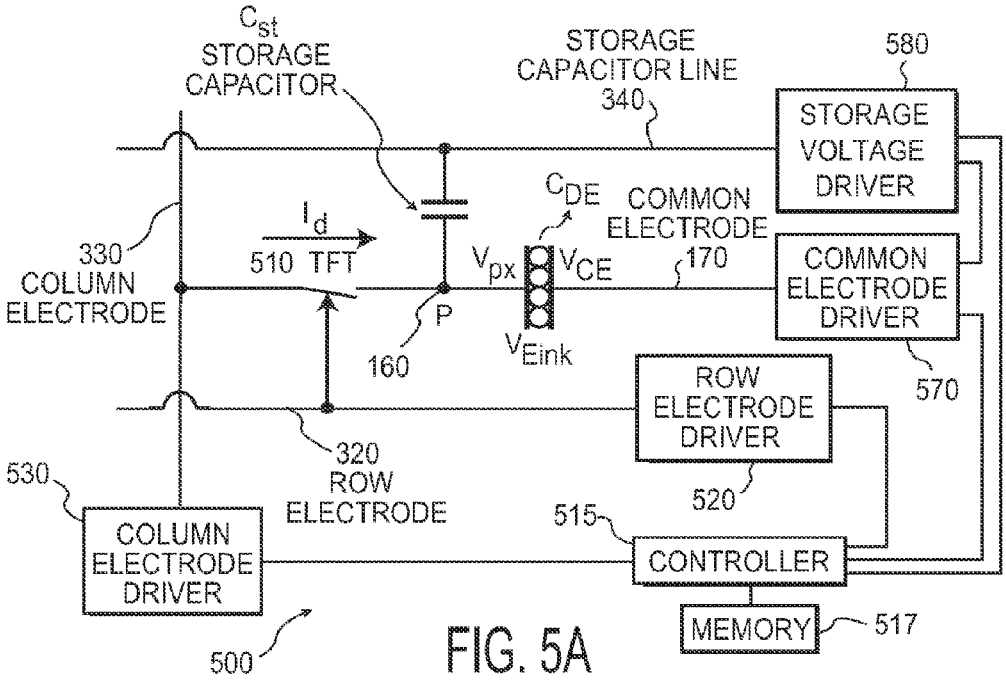
FIG. 5A shows a simplified circuit for the active matrix pixel circuit according to one embodiment.

FIG. 5A shows a simplified circuit 500 similar to the active matrix pixel circuit 300 shown in FIG. 3, where the TFT 310 is represented by a switch 510 controlled by a signal from the row electrode 320, and the pixel or E-ink is represented by a pixel capacitor $C_{DE}$ connected between one end of the TFT switch 510 and the common electrode 170. The other end of the TFT switch 510 is connected to the column electrode 330.

The TFT 310 or switch 510 closes or conducts when a voltage, e.g., negative voltage, form the row electrode is applied to the TFT gate G resulting in the flow of current Id through the TFT 310 (or switch 510) between its source S and drain D. As current Id flows through the TFT, the storage capacitor $C_{st}$ is charged or discharged until the potential of pixel node P at the TFT drain D equals the potential of the column electrode, which is connected to the TFT source S. If the row electrode potential is changed, e.g., to a positive voltage, then the TFT 310 or switch 510 will close or become non-conductive, and the charge or voltage at the pixel node P will be maintained and held by the storage capacitor C. That is, the potential at the pixel node P, referred to as the pixel voltage $V_{px}$ at the TFT drain D will be substantially constant at this moment as there is no current flowing through the TFT 310 or switch 510 in the open or non-conductive state.

The amount of charge on the storage capacitor $C_{st}$ provides or maintains a certain potential or voltage difference between the storage capacitor line 340 and pixel node P of the pixel capacitor $C_{DE}$. If the potential of the storage capacitor line 340 is increased by 5V, then the potential at the pixel node P will also increase by approximately 5V, assuming $\Delta V_{px} \approx \Delta V_{st}$ as will be described. This is because the amount of charge at both nodes of the storage capacitor $C_{st}$ is the same since the charges cannot go anywhere.

It should be understood that for simplicity, it is assumed that the change in the pixel voltage $\Delta V_{px}$ across the pixel $C_{DE}$ is approximately equal to the change in the storage capacitor voltage $\Delta V_{st}$ across the storage capacitor $C_{st}$, i.e., $\Delta V_{px} \approx V_{st}$. This approximation holds true particularly when $C_{st}$ is the dominant capacitor, which should be the case. A more exact relation between $V_{px}$ and $V_{st}$ is given by equation (1):

$$\Delta V_{px}=(\Delta V_{st})[(C_{st})/(C_{TOTAL})] \quad (1)$$

where $\Delta V_{px} \approx \Delta V_{st}$ when $C_{TOTAL} \approx C_{st}$ and thus $(C_{st})/(C_{TOTAL}) \approx 1$ The total pixel capacitance $C_{TOTAL}$ is defined as the sum of all capacitance, namely:

$$C_{TOTAL}=C_{st}+C_{DE}+C_{rest} \quad (2)$$

where $C_{rest}$ is the sum of all other capacitance (including parasitic capacitance) in the pixel.

Further it should be noted that, in addition to expressing the change in the pixel voltage $\Delta V_{px}$ (at node P in FIG. 5A) in terms of the change in the voltage $\Delta V_{st}$ (across the storage capacitor $C_{st}$) as shown in equation (1), $\Delta V_{px}$ may be expressed in terms of the change in the common voltage $\Delta V_{CE}$ as shown in equation (3):

$$\Delta V_{px}=(\Delta V_{st})[(C_{st})/C_{TOTAL})]=\Delta V_{CE})[(C_{DE})/(C_{TOTAL})] \quad (3)$$

where $C_{DE}$ is capacitance of the display effect or pixel.

It is desired not to effect the voltage across the pixel $V_{Eink}$ and thus not to effect the displayed image when voltages are changed. Having no display effects or no pixel voltage change means that $\Delta V_{Eink}=0$.

Since $V_{Eink}=V_{CE}-V_{px}$ then:

$$\Delta V_{Eink}=\Delta V_{CE}-\Delta V_{px}=0 \quad (4)$$

Equation (4) indicates the desirable maintenance of the displayed image with substantially no changes in display effects when voltages are changed. That is, the change in the voltage across the pixel $\Delta V_{Eink}$ is desired to be zero so that black or white states are maintained without any substantial change, for example.

Substituting $\Delta V_{px}$ from equation (3) into equation (4) yields:

$$\Delta V_{CE}-(\Delta V_{st})[(C_{st}/C_{TOTAL})]=0 \quad (5)$$

It can be seen from equation (5) that the relation between $\Delta V_{CE}$ and $\Delta V_{st}$ may be given by equations (6) and (7)

$$\Delta V_{CE}(\Delta V_{st})[(C_{st}/C_{TOTAL})] \quad (6)$$

$$\Delta V_{st}(\Delta V_{CE})[(C_{TOTAL}/C_{st})] \quad (7)$$

Thus, when the common electrode voltage is changed by an amount $\Delta V_{CE}$, then it is desired to change the voltage on the storage line by $\Delta V_{st}$ that satisfies equation (7).

As seen from equation (6) or (7), in order to prevent any voltage change $\Delta V_{Eink}$ across the pixel $C_{DE}$ i.e., to ensure that $\Delta V_{Eink}=0$, and thus substantially maintain the same display effect with substantially no change of the displayed image, the common voltage $V_{CE}$ and the storage capacitor voltage $V_{st}$ are changed at substantially the same time and by substantially the proper amount with respect to each other as shown by equations (6) or (7). In particular, when $V_{st}$ and $V_{CE}$ are changed by amounts that satisfy equation (6) or (7) and at substantially the same time, then there will be no change in the voltage across the pixel $C_{DE}$, i.e., $\Delta V_{Eink}=0$.

The voltage across the pixel capacitor $C_{DE}$, i.e., the voltage difference between the common electrode 170 and the pixel node P (i.e., $V_{Eink}$) is responsible for switching of the display and forming an image along with the rest of the pixel matrix array. If the potential on the common electrode 170 and the storage capacitor line 340 are changed at substantially the same time (e.g., the two are connected together or are under the control of the same controller 515), and with amounts that substantially satisfy equation (6) or (7), then the potential at the pixel node P will change by substantially the same amount as the potential change of the common electrode voltage and at substantially the same time. Effectively, this means that voltage $V_{Eink}$ across the pixel capacitor $C_{DE}$ remains constant (i.e., $V_{Eink}=0$).

On the other hand, if the common electrode 170 and the storage capacitor line 340 are not connected together, then a voltage $V_{CE}$ change of the common electrode 170 will also have an effect or change the voltage $V_{Eink}$ across the pixel capacitor $C_{DE}$. That is, the change in the common electrode potential $V_{CE}$ will have an effect on the whole display. Further, if the common electrode potential $V_{CE}$ is changed while a row is selected (i.e., TFT 310 is closed or conducting), it will result in a different behavior for that selected row and will result in image artifacts.

It should be noted that the storage capacitor $C_{st}$ in an active-matrix circuit designed to drive the E-ink (or pixel/display effect capacitor $C_{DE}$) is 20 to 60 times as large as the display effect capacitor $C_{DE}$ and gate-drain capacitors Co. Typically, the value of the display effect capacitor $C_{DE}$ is small due to the large cell gap of the E-ink and the relatively large leakage current of the E-ink material. The leakage current is due to a resistor in parallel with the display effect capacitor $C_{DE}$. The small value of the display effect capacitor $C_{DE}$ coupled with the leakage current require a relatively large storage capacitor $C_{st}$.

The various electrodes may be connected to voltage supply sources and/or drivers which may be controlled by a controller 515 that controls the various voltage supply sources and/or drivers, shown as reference numerals 520, 530, 570, connected to the row electrode 320, the column electrode 330, and the common electrode 170, respectively. The controller 515 drives the various display electrodes or lines, e.g., pixel cell shown in the equivalent circuit 500, with pulses having different voltage levels as will be described.

To realize the proper amount and timing of changes of the voltages of the storage capacitor voltage $V_{st}$ and common voltage $V_{CE}$, namely changing both storage and common voltages $V_{st}$, $V_{CE}$ at substantially the same time and by substantially the proper amount, namely, $\Delta V_{st}=(\Delta V_{CE})[(C_{ToTAL}/C_{st})]$, as shown in equation (7), the common electrode driver 570 may be connected to the storage capacitor line 340 through a storage capacitor line 340 through a storage driver 580 which may be programmable or controllable by the controller 515. In this case the storage driver 580 is a scaler which generates an output signal $V_{st}$ that corresponds to the common voltage $V_{CE}$. In other words, the voltage $V_{st}$ of the output signal varies proportionally, preferably linearly proportionally with the common voltage $V_{CE}$. Alternatively the storage driver 580 may be a driver separate from controller 515. In this case the connection between the common electrode driver 570 and the storage driver 580 is superfluous. The controller 515 may be configured to change the storage and common voltages $V_{st}$, $V_{CE}$ at substantially the same time and control the storage driver 580 such that the storage and common voltage changes correspond, e.g. satisfy the relationship shown by in equation (6) or (7), for example.

Figure 5B:
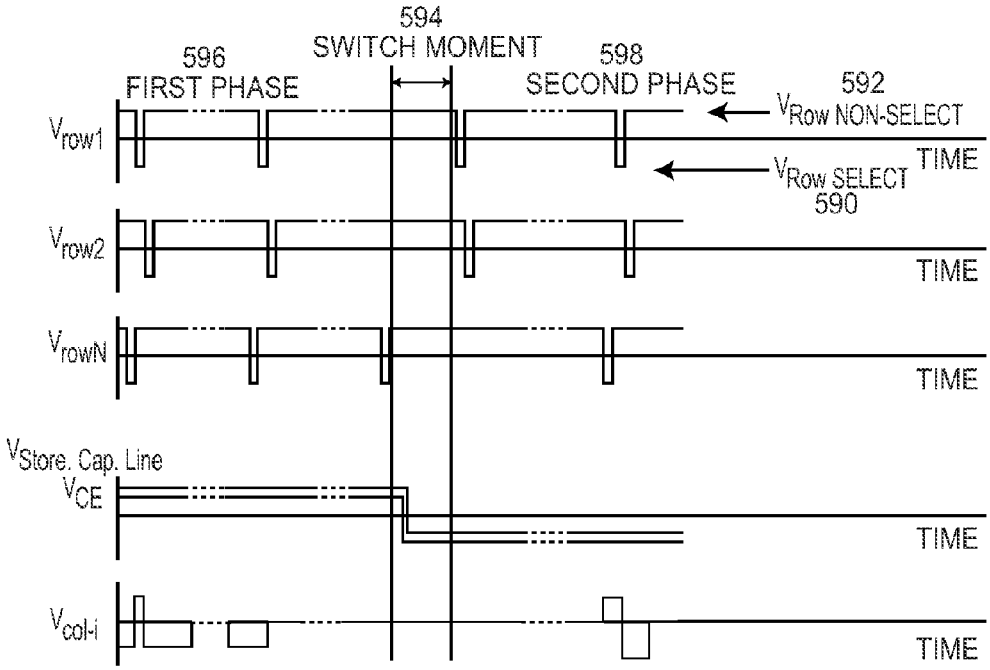
FIG. 5B shows a timing diagram for switching voltages according to one embodiment.

Artifacts may result in the displayed image if the storage and common voltages $V_{st}$, $V_{CE}$ are not switched at the substantially same time. Further, as shown in FIG. 5B, the storage and common voltages $V_{st}$, $V_{CE}$ are not only switched at substantially the same time, but also are switched when none of the rows are selected. Alternatively the Vce and Vst are switched at substantially the same time: (1) when no rows are selected; or (2) at the start of any row selection time; or (3) during a row selection time after which the selected row gets at least a full row selection period to charge the pixels to the column voltage level. In particular, preferably the switch of the Vce and the Vst does not result in one or more pixels being charged to an incorrect voltage (i.e. another voltage than the column voltage). In particular, FIG. 5B shows row or gate voltages of rows 1, 2 and N, where a low level 590 $V_{row\text{-}select}$, for example, selects a row or turns ON the TFT 510 (conductive state, switch closed), and a high level 592 $V_{row\ non\text{-}select}$ turns OFF the TFT 510 (non-conductive state, switch open). The rows are sequentially selected one at a time by applying an appropriate voltage level on a row, where none of the rows are selected during switching time period 594 separating first and second phases 596, 598, respectively. Alternatively the Vce and Vst are switched at substantially the same time: (1) when no rows are selected; or (2) at the start of any row selection time; or (3) during a row selection time after which the selected row gets at least a full row selection period to charge the pixels to the column voltage level. In particular, preferably the switch of the Vce and the Vst does not result in one or more pixels being charged to an incorrect voltage (i.e. another voltage than the column voltage). Although not relevant from the timing point of view of the changes in the common voltages $V_{st}$, $V_{CE}$, the column voltage is also shown in FIG. 5B for illustrative purposes. It should be noted that the switching time period 590 may occur during any desired time where the sequential row addressing is interrupted, such as after all the rows are addressed, or half the rows are addressed or after any number of rows are addressed, as desired. After the switch period 590, the next row is addressed and the sequential row addressing is resumed.

The controller 515 may be any type of controller and/or processor which is configured to perform operation acts in accordance with the present systems, displays and methods, such as to control the various voltage supply sources and/or drivers 520, 530, 570 to drive the display 500 with pulses having different voltage levels and timing as will be described. A memory 517 may be part of or operationally coupled to the controller/processor 515.

The memory 517 may be any suitable type of memory where data are stored, (e.g., RAM, ROM, removable memory, CD-ROM, hard drives, DVD, floppy disks or memory cards) or may be a transmission medium or accessible through a network (e.g., a network comprising fiber-optics, the world-wide web, cables, or a wireless channel using time-division multiple access, code-division multiple access, or other radio-frequency channel). Any medium known or developed that can store and/or transmit information suitable for use with a computer system may be used as the computer-readable medium and/or memory. The memory 517 or a further memory may also store application data as well as other desired data accessible by the controller/processor 515 for configuring it to perform operation acts in accordance with the present systems, displays and methods.

Additional memories may also be used. The computer-readable medium 517 and/or any other memories may be long-term, short-term, or a combination of long-term and short-term memories. These memories configure the processor 515 to implement the methods, operational acts, and functions disclosed herein. The memories may be distributed or local and the processor 515, where additional processors may be provided, may also be distributed or may be singular. The memories may be implemented as electrical, magnetic or optical memory, or any combination of these or other types of storage devices. Moreover, the term "memory" should be construed broadly enough to encompass any information able to be read from or written to an address in the addressable space accessed by a processor. With this definition, information on a network is still within the memory 517, for instance, because the processor 515 may retrieve the information from the network for operation in accordance with the present system.

The processor 515 is capable of providing control signals to control the voltage supply sources and/or drivers 520, 530, 570 to drive the display 500, and/or performing operations in accordance with the various addressing drive schemes to be described. The processor 515 may be an application-specific or general-use integrated circuit(s). Further, the processor 515 may be a dedicated processor for performing in accordance with the present system or may be a general-purpose processor wherein only one of many functions operates for performing in accordance with the present system. The processor 515 may operate utilizing a program portion, multiple program segments, or may be a hardware device, such as a decoder, demodulator, or a renderer such as TV, DVD player/recorder, personal digital assistant (PDA), mobile phone, etc, utilizing a dedicated or multi-purpose integrated circuit(s).

Any type of processor may be used such as dedicated or shared one. The processor may include micro-processors, central processing units (CPUs), digital signal processors (DSPs), ASICs, or any other processor(s) or controller(s) such as digital optical devices, or analog electrical circuits that perform the same functions, and employ electronic techniques and architecture. The processor is typically under software control for example, and has or communicates with memory that stores the software and other data such as user preferences.

Clearly the controller/processor 515, the memory 517, and the display 500 may all or partly be a portion of single (fully or partially) integrated unit such as any device having a display, such as flexible, rollable, and wrapable display devices, telephones, electrophoretic displays, other devices with displays including a PDA, a television, computer system, or other electronic devices. Further, instead of being integrated in a single device, the processor may be distributed between one electronic device or housing and an attachable display device having a matrix of pixel cells 500.

Figure 6A:
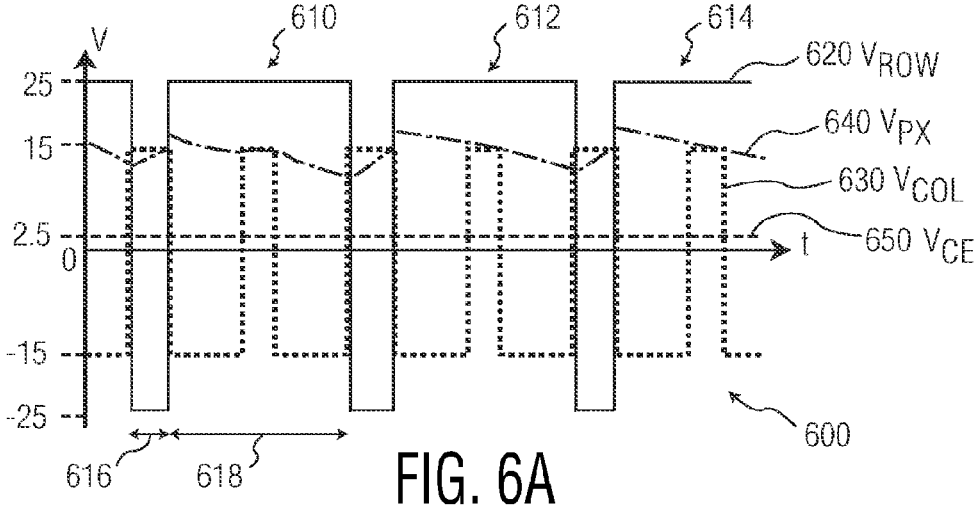
FIGS. 6A-6C show various voltage pulses during three frames using an active-matrix drive scheme for addressing E-ink.
Figure 6B:
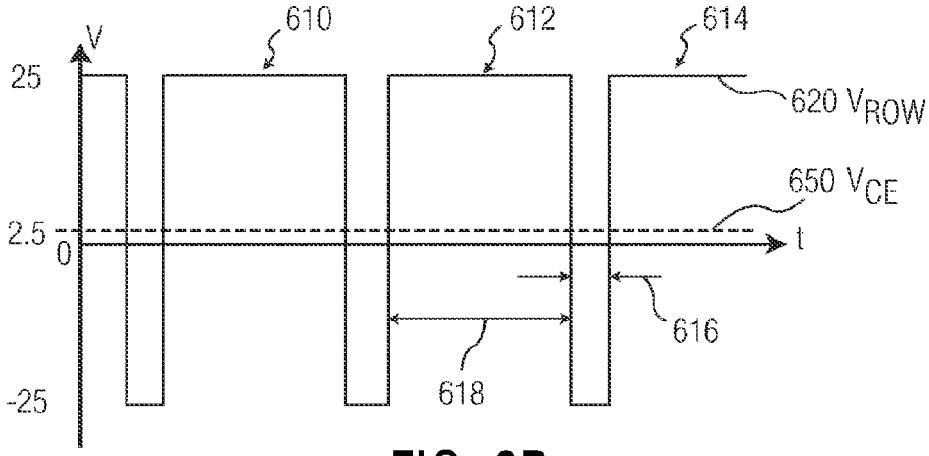
Figure 6C:
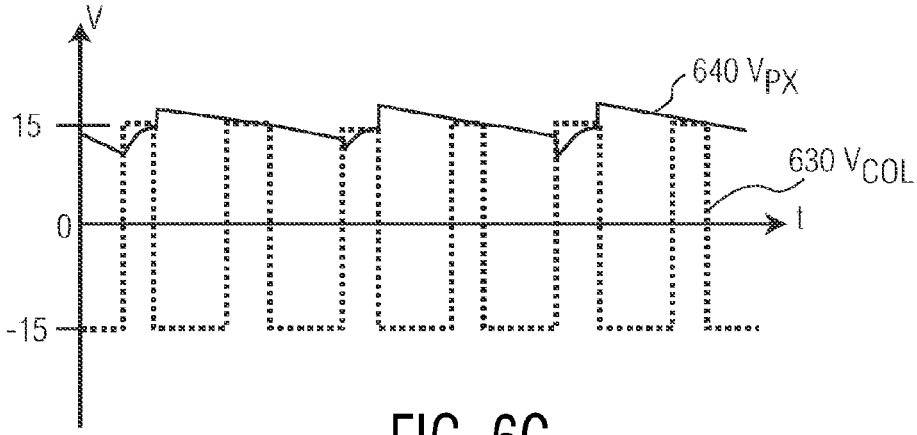

Active-matrix displays are driven one row-at-a-time. During one frame time, all the rows are sequentially selected by applying a voltage that turns on the TFTs, i.e., changes the TFTs from the non-conducting to the conducting state. FIGS. 6A-6C show voltage levels versus time at various nodes of the equivalent circuit (300 of FIG. 3 or 500 of FIG. 5A).

In particular, FIG. 6A shows a graph 600 of three frames 610, 612, 614 using the active-matrix drive scheme for addressing E-ink showing four superimposed voltage pulses. A solid curve 620 represents the row voltage $V_{row}$ present at the row electrode 320 of FIGS. 3 and 5, also shown in FIG. 6B which only shows two of the four voltage pulses, where the other two voltage pulses are shown in FIG. 6C for clarity. In FIG. 6A, the dashed line 650 is the voltage $V_{CE}$ present at the common electrode 170 shown in FIGS. 1, 3 and 5, also shown in FIG. 6B. In FIG. 6A, the dotted curve 630 represents the column voltage $V_{col}$ present at the column electrode 330 shown in FIGS. 3 and 5, also shown in FIG. 6C as a dotted line 630. A semi-dashed curve 640 in FIG. 6A represents the pixel voltage $V_{px}$ present at the pixel node P at one terminal of the pixel capacitor $C_{DE}$ of FIG. 5A, also shown in FIG. 6C as a dotted line 640 for clarity.

The graph 600 of FIG. 6A shows the pulses as applied in a polymer electronics active-matrix back plane with p-type TFTs. For n-type TFTs (e.g. amorphous silicon), the polarity of the row pulses and the common electrode voltage change. In this graph 600 shown in FIG. 6A, only 6 rows are addressed as shown by the 6 dotted pulses 630, however it is understood that an actual display contains much more rows.

During a hold or non-select period 618 of a frame 610 shown in FIG. 6A, the row voltage $V_{row}$ solid line 620 is high, e.g., 25V, thus turning OFF the TFT 310 (non-conducting state, i.e., switch 510 is open). During a select portion 616 of the frame 610 where the TFT 310 is conducting (i.e., switch 510 is closed and the selected row is addressed), the pixel capacitors $C_{DE}$ shown in FIG. 5A (i.e. the total capacitance at the drain side of the TFT 310 or switch 510) of the selected row are charged to the voltage supplied on the column electrodes 330. During the remaining frame time 618 (i.e. the hold time), the current row is not addressed but the other rows are addressed sequentially, for example, as shown in FIG. 5B. During the hold period 618, the TFTs are in their non-conducting state and the charge on the pixel capacitors is retained, e.g., by the charges stored in the storage capacitor $C_{st}$ (FIGS. 3 and 5), for example.

Figure 1:
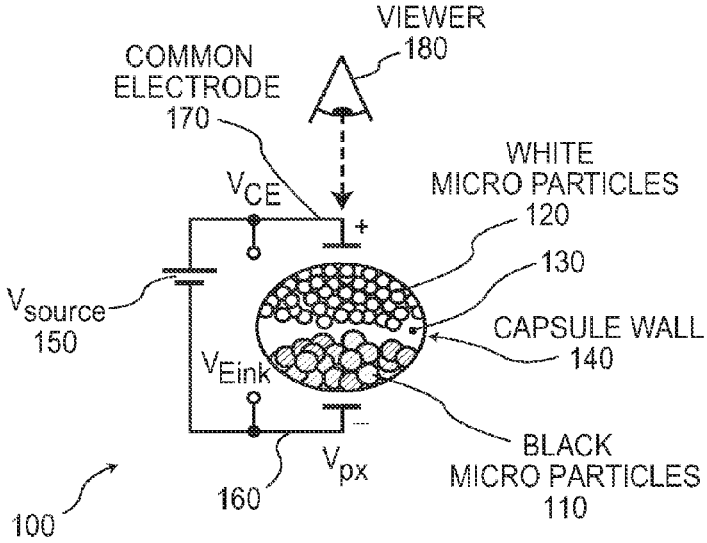
FIG. 1 PRIOR ART
FIG. 1 shows a conventional E-ink display device.

When a negative column voltage 630, e.g., −15V, is supplied to a pixel, this pixel switches towards the white state, and when a positive voltage is supplied on the column 530, e.g., +15V, then the pixel switches towards the black state, as shown in FIG. 1. During one frame, some pixels may be switched towards white, while others are switched towards black. For polymer electronics, active-matrix back planes of addressable TFTs or pixel electrodes with E-ink, the typical voltage levels are −25V for the row select voltage (during the select period 616), and a row non-select voltage of +25 V (during the non-select period 618), a column voltage between −15V (white pixel) and +15 V (black pixel), and a common electrode voltage of +2.5V, as shown in FIGS. 6A-6C.

Figure 7:
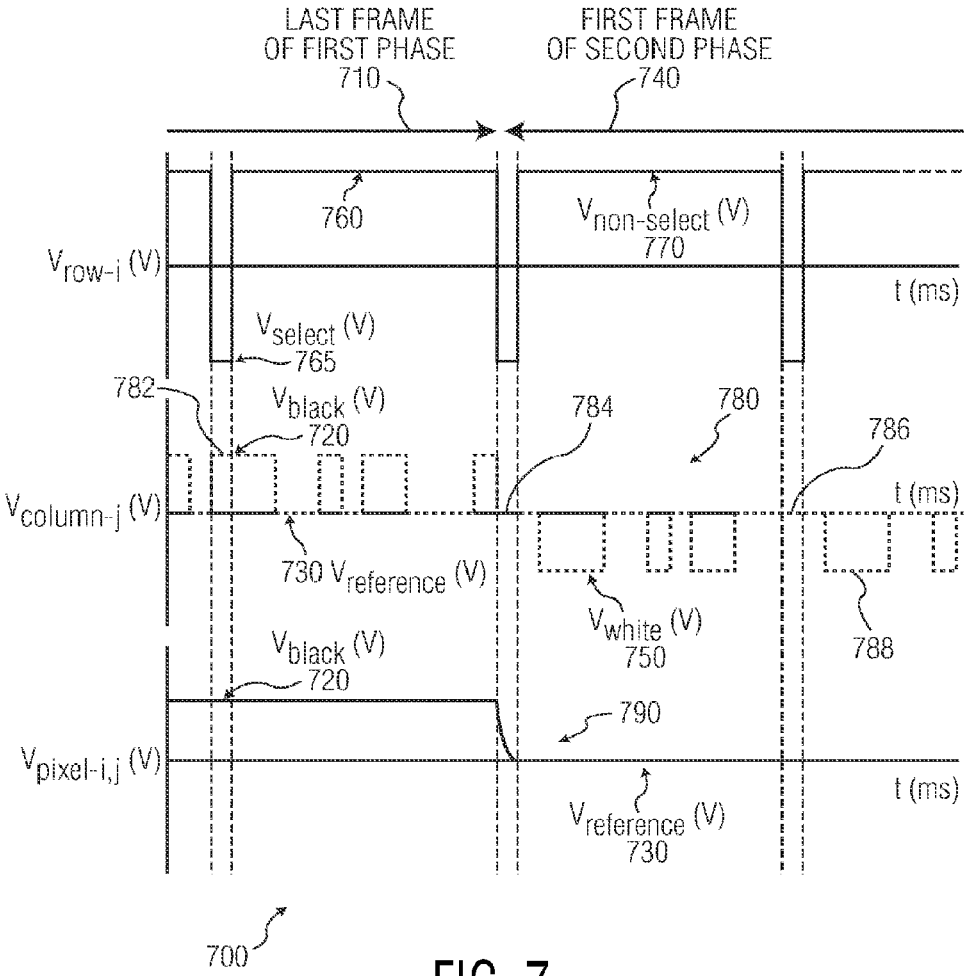
FIG. 7 shows waveforms for a color sequential driving scheme according to another embodiment.

FIG. 7 shows an addressing scheme 700 for a display where, for a monochrome (e.g., black and white or any other two colors) display for example, a complete image is written after two addressing phases. In the first addressing phase 710, the pixels that must be switched towards the black state are addressed with a first voltage level or 'black' voltage 720 (e.g., +15V), while all other pixels are addressed with a reference voltage $V_{ref}$ 730 (e.g., 0V). The pixels being addressed with the reference voltage $V_{ref}$ 730 do not change their switching state.

During the second addressing phase 740, the pixels that must be switched towards the white state are addressed with a second voltage level or 'white' voltage 750 (e.g., 15V), while all other pixels are addressed with a reference voltage (e.g., 0V), which again does not change their switching state during this second addressing phase 740. The result is that after these two addressing phases 710, 740, the complete (black and white) image is written.

FIG. 7 shows embodiments of waveform plots of signals with voltage in volts versus time in milliseconds, for example, for the described addressing scheme for a pixel that is switched towards the black state during the first addressing phase 710 and is kept black when the reference voltage is applied during the second addressing phase 720. The upper waveform signal 760 in FIG. 7 is applied to row i, where a low voltage level 765 $V_{select}$ of the row voltage $V_{row}$ (or $V_{gate}$ applied to the row electrode 320) is the row select voltage level $V_{select}$, and a high voltage level 770 $V_{non\text{-}select}$ is the non-select voltage level applied to the gate(s) G of the TFT(s) 310 (or switches 510 of FIGS. 3 and 5) to close the TFT switch(es) 310, 510, i.e., to select the conductive state of the TFT(s) 310.

The middle waveform signal 780 in FIG. 7 is applied to a column j, where the solid lines 782, 784, 786 show the voltage levels ($V_{black}$ 720 and $V_{ref}$ 750) applied to the pixel at the crossing between row i and column j. The dotted lines 788 show the voltage applied to the other pixels attached to this column j which include voltage levels $V_{black}$ 720, $V_{ref}$ 730 and $V_{white}$ 750.

The lower waveform signal 790 in FIG. 7 is the pixel voltage $V_{px}$ at node P (FIGS. 3 and 5) applied to the pixel capacitor $C_{DE}$ at the crossing of row i and column j, i.e., associated with the solid lines 782, 784, 786 of the middle waveform signal 780. The last frame of the first addressing phase 710 is shown, where $V_{black}$ 720 is applied at 782 to the pixel capacitor $C_{DE}$ (i.e., $V_{px}=V_{black}$) and thus the pixel is switched towards the black state. This is followed by the first frame of the second addressing phase 720, where the pixel is charged to the reference voltage $V_{ref}$ 730 at 784 that does not change its switching state, and thus the particles in the E-ink capsule 140 (FIG. 1) remain at their current locations and do not move, i.e., the pixel remains in the black state. During the first frame of the second addressing phase 720, the other pixels (not shown here) are charged towards the white state. Thus, the complete image is written after these two addressing phases.

In one embodiment, a color sequential update method is performed with reduced addressing voltages. In particular, when the addressing method of FIG. 7 is used, the column voltage $V_{col}$ may be reduced by a factor 2 and the row voltage $V_{roe}$ is also reduced accordingly. This reduces the power consumption of the display and makes it possible to use a wider range of commercially available row and column drivers. For flexible, polymer electronics displays, reduction of the column and row voltages also increases the lifetime of the display, since the required row voltage swing also determines the stress effect in the transistors.

Figure 8A:
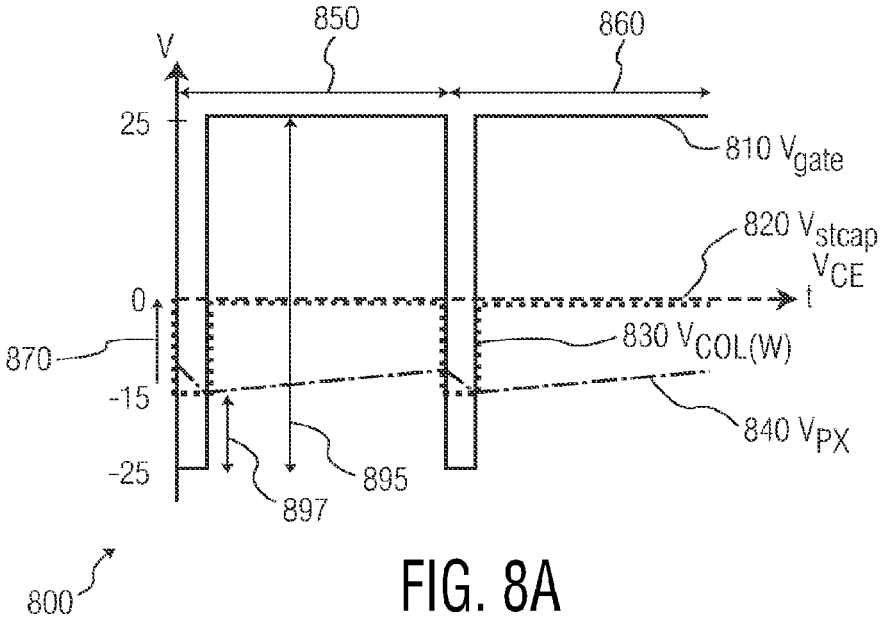
FIG. 8A PRIOR ART
FIGS. 8A-8B show waveforms for two frames using a conventional drive scheme.
Figure 8B:
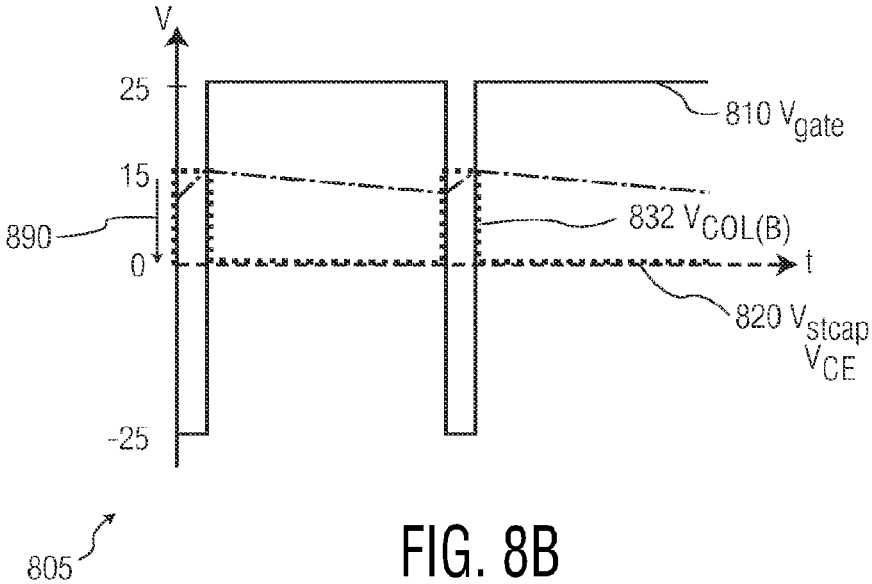
FIG. 8B PRIOR ART
Figure 9A:
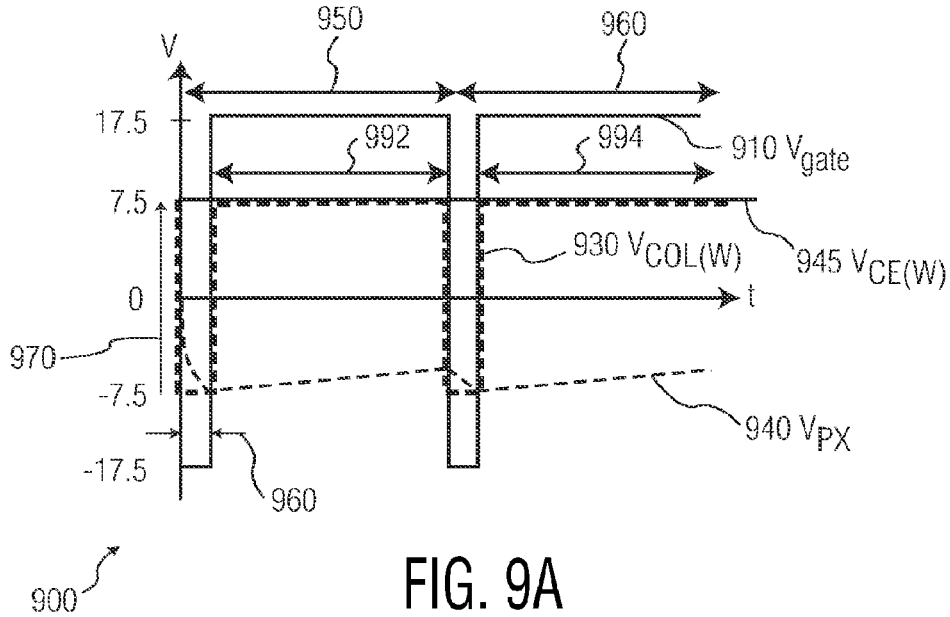
FIGS. 9A-9B show waveforms for two frames using color sequential active-matrix drive scheme according to yet another embodiment.
Figure 9B:
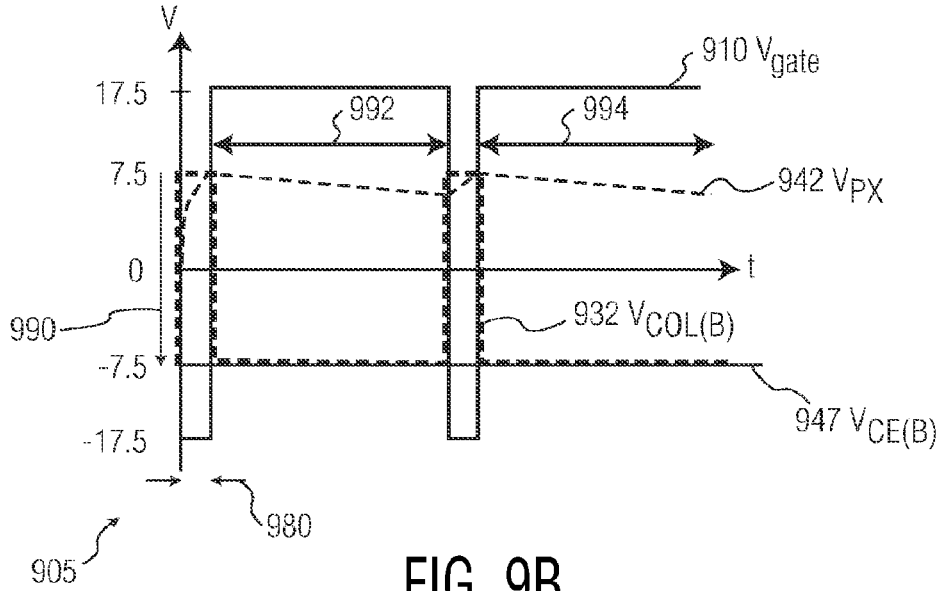

In FIGS. 8A-8B, a conventional drive scheme is shown and in FIGS. 9A-9B, a drive scheme according to one embodiment is shown with column voltages that are twice as low as that of the conventional drive scheme shown in FIGS. 8A-8B.

FIGS. 8A-8B show voltage levels of various signals versus time for two frames using a conventional active-matrix drive scheme 800, 805, respectively. The solid curve 810 shows the voltage on one row $V_{row}$, which is the gate voltage $V_{gate}$ of the TFT 310 (FIG. 3). The gate or row $V_{row}$ (or $V_{gate}$) is between +25V and −25 V. The 0V DC voltage curve shown as dashed line 820 is the voltage on the corresponding storage capacitor line 340 shown in FIGS. 3 and 5, as well as the common electrode voltage $V_{CE}$ also shown in FIGS. 3 and 5. The dotted curve 830 is the voltage on a column $V_{col}$ which is between +15V and −15 V. The dashed curve 840 is the pixel voltage $V_{px}$ (at node P) applied to the pixel attached to the row and the column, represented by the pixel capacitor $C_{DE}$ shown in FIGS. 3 and 5.

Figure 4:
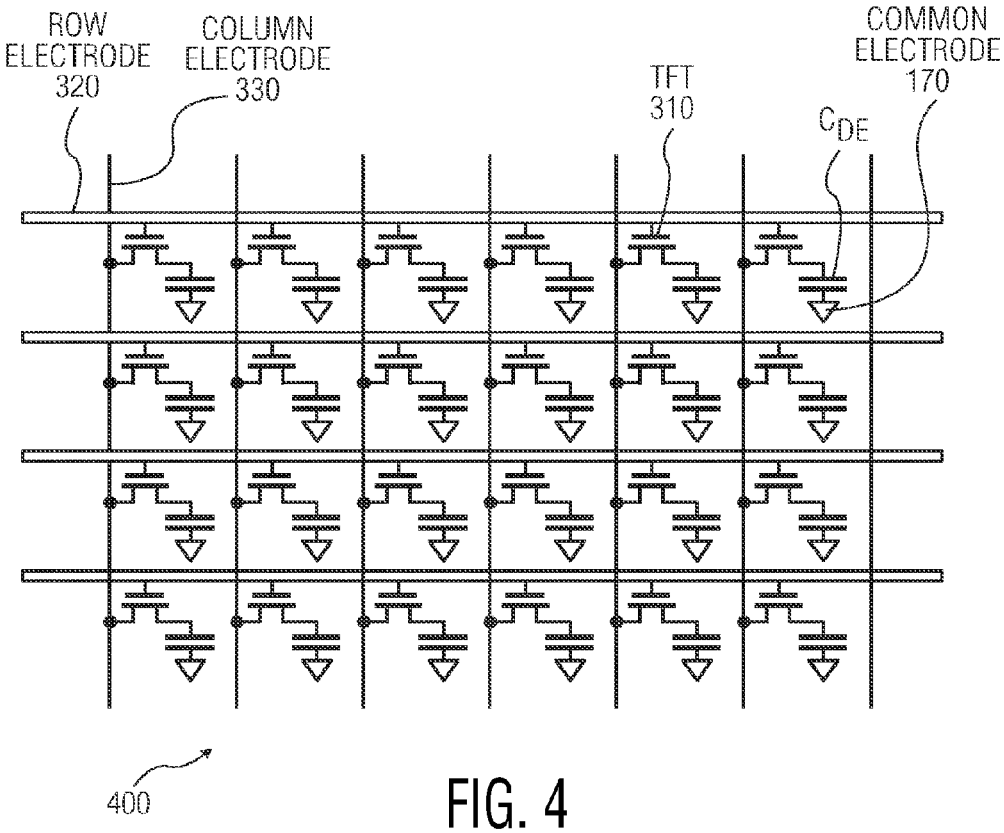
FIG. 4 PRIOR ART
FIG. 4 shows an array of cells of an active-matrix display.

FIG. 8A shows a negative dotted curve or $V_{col}$ 830 and a corresponding negative pixel voltage $V_{px}$, such as −15 V (e.g., a white pixel) applied to node P of FIGS. 4 and 5, which is the pixel electrode 160 shown in FIG. 1. As shown by the dashed curve or $V_{px}$ 840, the negative pixel voltage $V_{px}$ that begins to discharge slightly (where its value tends towards zero volts) upon turning OFF the TFT switch 310 (FIG. 3 or opening the switch 510 shown in FIG. 5A) by the gate or row $V_{row}$, i.e., $V_{row}$=+25V. FIG. 8B shows a positive dotted curve or $V_{col}$ 832 and a corresponding positive pixel voltage $V_{px}$, such as +15 V (e.g., a black pixel), where the positive pixel voltage $V_{px}$ 842 begins to also discharge slightly (where its value tends towards zero volts) upon turning OFF the TFT switch 310 (FIG. 3) by the gate or row $V_{row}$, (i.e., $V_{row}$=+25V).

As shown by the dashed curve or $V_{px}$ 840, 842, the pixel voltage $V_{px}$ starts at 0 V before the first frame 850, discharge slightly and is close to the required pixel voltage at the start of the second frame 860. Although the column electrode voltage $V_{col}$ 830, 832 is 0V between two row selection or gate pulses 810, the column voltage in an actual or real display may not be quite 0V because the other pixels attached to the column are addressed. The pulses shown in FIGS. 8A-8B are typical pulses in a polymer electronics active-matrix back plane with p-type TFTs. For n-type TFTs (e.g. amorphous silicon), the polarity of the row pulses and the common electrode voltage are inverted.

FIGS. 9A-9B show voltage levels of the signals comparable to those shown in FIGS. 8A-8B versus time for two frames using a black and white or color sequential active-matrix drive scheme 900, 905 according to one embodiment of the present display and drive method. Although two pixel voltage levels are associated with black and white pixel, it should be understood than any two colors may be associated with the two pixel voltage levels, as well as that additional pixel voltage levels may be provided to form color images, such as additional (or alternative) red, green and blue pixel levels.

Similar to curves shown in FIGS. 8A-8B, in FIGS. 9A-9B, the solid curve 910 shows the voltage on one row $V_{row}$. The dotted curves 930, 932 are the voltage levels on a column $V_{col}$. The dashed curve 940, 942 are the pixel voltage levels $V_{px}$ applied at node P to a pixel ($C_{DE}$ in FIG. 5A) that is attached to the row and the column. The solid lines 945 at 7.5V in FIG. 9A and 947 at −7.5V in FIG. 9B show the common electrode voltage $V_{CE}$.

It should be noted that the column voltage $V_{col}$ 930 in FIGS. 9A-9B is reduced to be between +7.5V and −7.5 V, instead of +15V and −15 V in FIGS. 8A-8B. Further, as shown in FIG. 9A, when the column voltage $V_{col}$ 930 is −7.5V when a pixel is addressed at time period 960 (i.e., when the gate or row $V_{col}$ voltage is −17.5 V and the TFT 310 (FIG. 3) or switch 510 (FIG. 5A) is closed (i.e., TFT in conducting state), then $V_{px}$=$V_{row}$=−7.5V), and the common electrode voltage $V_{CE}$ 945 is +7.5V in FIG. 9A instead (0V in FIGS. 8A-8B). Thus, the potential rise (arrow 970) or voltage across the pixel or $C_{DE}$ (FIG. 5A), namely, $V_{CE}$−$V_{px}$ is +7.5−(−7.5V)=+15V, which is the same potential rise (arrow 870) or voltage across the pixel $C_{DE}$ shown in FIG. 8A, namely, 0−(−15V)=+15V.

Similarly, as shown in FIG. 9B, when the column voltage $V_{col}$ 930 is +7.5V when a pixel is addressed at time period 980, then the common electrode voltage $V_{CE}$ 947 is −7.5V instead 0V as shown by reference numeral 820 in FIG. 8B. Thus, the potential drop (arrow 990) or voltage across the pixel $C_{DE}$, namely, $V_{CE}$−$V_{px}$ is −7.5 V−(+7.5V)=−15V, which is the same potential drop (arrow 990) or voltage across $C_{DE}$ shown in FIG. 8A, namely, 0−(+15V)=−15V.

As described, the drive methods shown in FIGS. 8A-8B and 9A-9B have the same potential (rise or drop) across the pixel $C_{DE}$ of 15V, but this 15V potential difference across the pixel $C_{DE}$ in the drive method shown in FIGS. 9A-9B is achieved with a reduced absolute voltage levels, such as the column voltage $V_{col}$ being reduced to +7.5V from the +15V level shown in FIG. 9B, and also shown in FIG. 9A where the absolute value of the column voltage $V_{col}$ is reduced to 7.5V from 15V.

Correspondingly, as compared to the conventional drive scheme 800, 805 shown in FIGS. 8A-8B, the column voltage $V_{col}$ 930, 932 is also reduced to between +7.5V and −7.5V (from ±15 in FIGS. 8A-8B). The gate or row voltage $V_{row}$ or $V_{gate}$ 910 is also reduced in the color sequential active-matrix drive scheme 900, 905 shown in FIGS. 9A-9B. In particular, the gate or row $V_{row}$ is changed or reduced to be between +17.5V and −17.5V instead of ±25 of the conventional drive scheme 800, 805 shown in FIGS. 8A-8B.

As shown in FIGS. 9A-9B, the pixel voltage $V_{px}$ starts at 0V before the first frame 950, while it is close to the required pixel voltage at the start of the second frame 960. The column voltage $V_{col}$ is equal to the common electrode voltage $V_{CE}$, (e.g., equal to +7.5V in FIG. 9A and −7.5V in FIG. 9B) when a pixel is not switched during the addressing phase (i.e., when the gate or row voltage $V_{row}$ is +17.5V). In FIG. 8A, the pixel is charged to V=−7.5V (e.g. a white pixel), while the common electrode is set to +7.5 V. The reference voltage (or the level of the column voltage $V_{col}$ applied to the other pixels during time periods 992, 994) is +7.5 V for the other pixels that are not switched during this addressing phase 992, 994 (i.e., when the gate or row voltage $V_{row}$ is +17.5V). In FIG. 8B, the pixel is charged to +7.5 V (e.g. a black pixel), while the common electrode is set to −7.5 V. The reference voltage is −7.5 V for pixels that are not switched during this addressing phase 992, 994. The curves in FIGS. 9A-9B are the pulses as applied in a polymer electronics active-matrix back plane with p-type TFTs. For n-type TFTs (e.g. amorphous silicon), the polarity of the row pulses and the common electrode voltage are inverted.

By choosing a different common electrode voltages $V_{CE}$ for the two drive phases, namely +7.5V during the 'white' phase shown in FIG. 9A and −7.5V during the 'black' phase shown in FIG. 9B, the display is addressed with a column voltage swing 970, 990 of 15V (e.g. between −7.5V and +7.5 V), which is twice as low as the column voltage swing of 30V used in the conventional addressing scheme shown in FIGS. 8A-8B by the combination of arrows 770 and 780, where the column voltage swing of 30V is between ±15V.

The effective pixel voltage $V_{pxeff}$ (where $V_{pxeff}$ is the pixel voltage at node P of FIG. 5A relative to the common electrode voltage $V_{CE}$) during the 'white' phase (FIG. 9A) is −15V for the pixels that are switched towards the white state (i.e., the pixels is charged with an equivalent or effective voltage of −15V, not −7.5V), and 0V for the pixels that are not switched during this addressing phase. That is, those pixels (that are not switched) are charged at node P (FIG. 5A) to +7.5V, where +7.5V is equal to the common electrode voltage $V_{CE}$ (FIG.

9A) thus resulting in an effective pixel voltage $V_{pxeff}$ of 0V. In other words, the voltage level $V_{Eink}$ across the pixel capacitor $C_{DE}$ is 0V since there is no voltage difference across pixel capacitor $C_{DE}$ (as the same voltage level of +7.5V is provided to both terminals of the pixel capacitor $C_{DE}$ shown in FIG. 5A).

The effective pixel voltage $V_{pxeff}$ during the 'black' phase (FIG. 9B) is +15V for the pixels that are switched towards the black state (i.e., the pixels is charged with an equivalent or effective voltage of +15V, not +7.5V), and 0V for the pixels that are not switched during this addressing phase. That is, those pixels (that are not switched) are charged at node P (FIG. 5A) to −7.5V, where −7.5V is equal to the common electrode voltage $V_{CE}$ (FIG. 9B) thus resulting in an effective pixel voltage $V_{pxeff}$ of 0V.

The voltage levels $V_{Eink}$ across the pixel $C_{DE}$ (FIG. 5A) of ±15V may be changed to ±7.5V, e.g., by changing the common voltage $V_{CE}$ to charge the pixel with 0V (instead of charging the pixel with ±7.5V). When $V_{CE}$=0V, then the voltage levels across the pixel $V_{Eink}$ is ±7.5V (instead of ±15V), namely, from −7.5 V ('white' phase) to +7.5 V ('black' phase). Providing for two different voltage levels across the pixel $V_{Eink}$, e.g., ±15V and ±7.5V, allows driving a pixel between black and white with two different speeds.

It should be noted that, with the drive scheme according the various described embodiments, the voltage $V_{Eink}$ across the pixel $C_{DE}$, i.e., ±15V swing, are identical to the conventional drive scheme, as seen from arrows 870, 890 in FIGS. 8A-8B and arrows 970, 990 in FIGS. 9A-9B. However, the required column voltages $V_{col}$ are reduced with a factor 2 from 15V (reference numeral 830 in FIGS. 8A-8B) to 7.5V (reference numeral 830 in FIGS. 8A-8B).

Figure 2:
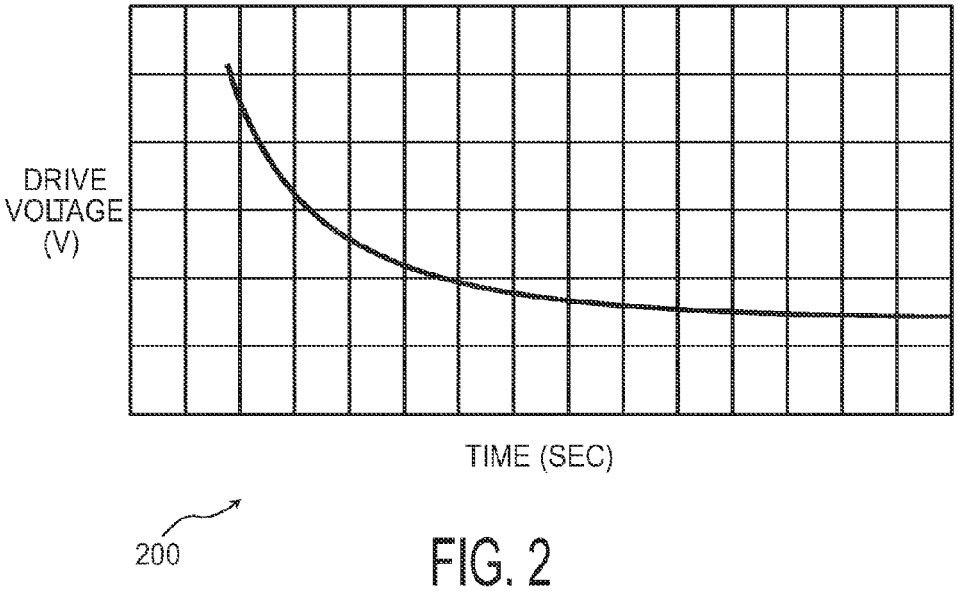
FIG. 2 PRIOR ART
FIG. 2 shows the switching speed of E-ink as a function of the addressing voltage.

For the color sequential drive scheme 900, 905 shown in FIGS. 9A-8B, the total image update time will be longer than the conventional drive scheme 800, 805 of FIGS. 8A-8B, due to the lower actual-absolute pixel of 7.5V instead of 15V. However, due to the non-linear relationship between drive voltage and image update time as shown in FIG. 2, the reduction in image update time will typically be a factor between 1.1 and 2, depending on the update sequence chosen. When the conventional addressing scheme 800, 805 was used with twice as low column voltages, i.e. 7.5V instead of 15V, the image update time increased by more than a factor 2 or 3; where for the color sequential drive scheme 900, 905 of FIGS. 9A-9B, the factor is between 1.1 and 2. That is, with reduced column voltage levels of .+−.7.5V (instead of the .+−.15V of FIGS. 8A-8B) for both drive schemes shown in FIGS. 8A-8B and FIGS. 9A-9B, the increase in image update time (or decrease in image update speed) is less for the color sequential drive scheme 900, 905 of FIGS. 9A-9B, as compared to the conventional drive scheme 800, 805 of FIGS. 8A-8B.

As seen from FIGS. 8A-8B and 9A-9B, the row or gate voltage $V_{row}$ (or $V_{gate}$) may also be lowered accordingly, e.g., from 25V to 17.5V. In the conventional drive scheme shown in FIGS. 8A-8B, the row select voltage is −25 V, while the row non-select voltage was +25 V (e.g. 10 V lower and higher than the column voltages of ±15V). In the color sequential addressing scheme shown in FIGS. 9A-9B, the row select and non-select voltages are −17.5 V and +17.5 V, respectively, while the pixel charging properties remain identical to the conventional addressing scheme (of FIGS. 8A-8B) since the effective pixel voltage $V_{px}$ or swing is the same in both the conventional (FIGS. 8A-8B) and color sequential drive (FIGS. 9A-9B) schemes, namely, ±15V as seen from arrows 870, 890 and 970, 990 in FIGS. 8A-8B and 9A-9B, respectively.

It should also be noted that, instead of having large values for the common electrode voltage $V_{CE}$, such as ±7.5V (FIGS. 9A-9B), the value or level of the common electrode voltage $V_{CE}$ may be chosen to be 0V, (similar to $V_{CE}$ level of FIGS. 8A-8B) or a small positive voltage equal to the kickback, during the two (white and black pixel) addressing phases shown in FIGS. 9A-9B. In the case where the $V_{CE}$ level is approximately 0V, the column and row voltages are then be chosen differently during the two addressing phases of FIGS. 9A-9B to maintain the same voltage difference $V_{Eink}$ across the pixel $C_{DE}$ (FIG. 5A) e.g., of approximately ±15V.

Kickback refers to the following phenomenon. During the conducting state of the TFT ($V_{row}$=−17.5V) the small gate-drain parasitic capacitor $C_{gd}$ and the capacitors $C_{st}$ and $C_{DE}$ will be charged (FIGS. 3 and 5). At the moment that the TFT is switched off ($V_{row}$ will be switched to 17.5V) the voltage over capacitor $C_{gd}$ will increase by 35V (from −17.5V to +17.5V). Charges will move from $C_{gd}$ to $C_{st}$ and $C_{DE}$ resulting in an increase of $V_{px}$ just after the TFT is switched off. Because $C_{gd}$ is relatively small compared to the other capacitors, the increase of the potential of $V_{px}$ is also small.

In general, a small additional $\Delta V_{CE}$ is required on top of the mentioned $V_{CE}$ voltages (e.g., on lop of −7.5, 0, +7.5V). The reason is that parasitic capacitances (e.g., $C_{gd}$) in the pixel cause a small voltage jump when the row changes from low to high voltage. This jump is called the kickback voltage $V_{KB}$ and can be calculated as follows: $\Delta V_{KB}=(\Delta V_{row}(C_{gd}/C_{TOTAL})$. This must be added to $V_{CE}$ in order to have the right $V_{Eink}$. Thus, it should be understood that this small additional kickback voltage should be added to all the described $V_{CE}$ voltages.

It should further be noted that the power consumption (of the color sequential addressing scheme of FIGS. 9A-9B) is lower (than that for the conventional addressing scheme of FIGS. 8A-8B), because power consumption is proportional to the square of drive voltages, such as the column, row and common electrode voltages which together are responsible for a certain voltage $V_{Eink}$ pixel $C_{DE}$ (which makes the ink switch). Changes to $V_{row}$ and $V_{col}$ and $V_{CE}$ contribute to the power consumption by a square relationship.

The following calculations compare the power consumption for the conventional and the color sequential addressing drive schemes of FIGS. 8A-8B and FIGS. 9A-9B. The power consumption of a polymer electronics QVGA (Quarter Video Graphics Array) active-matrix E-ink display is calculated for both the conventional and the color sequential addressing drive schemes. Such an E-ink display is a standard active-matrix design: therefore the following power consumption calculations for this design is representative for active-matrix displays in general.

The total power consumption with the conventional drive 800, 805 (of FIGS. 8A-8B) is:

$$P_{QVGA\text{-}conv}=P_{rows}+P_{columns} \tag{1}$$

The power consumption of the rows ($P_{rows}$) can be calculated with the following expression:

$$P_{rows}=N_{rows}C_{row}(V_g^{off}-V_g^{on})^2 f \tag{2}$$

The power consumption of the rows with $N_{rows}$=240, $C_{row}$=87 pF, $V_{rowoff}$=25 V, $V_{row}$ on=−25 V and f=50 Hz is 2.6 mW.

The power consumption of the columns ($P_{columns}$) can be calculated with the following expression:

$$P_{column}=\tfrac{1}{2}N_{cols}C_{column}(V_{data}^{max}-V_{data}^{min})^2 f N_{rows} \tag{3}$$

The maximum power consumption of the columns with $N_{rows}$=240, $N_{cols}$=320, $C_{column}$=26 pF, $V_{data}$ min=−15 V, $V_{data}$ max=15 V and f=50 Hz is 48 mW. This is only reached when a checkerboard is inverted.

The total power consumption with the color sequential addressing drive scheme 900, 905 (of FIGS. 9A-9B) is:

$$P_{QVGA\text{-}prop}=P_{rows}+P_{columns} \quad (4)$$

For this calculation a voltage swing on the rows of 35 V and a column voltage swing of 15 V will be used. The power consumption on the rows will now be 2.6 mW/$50^2\times35^2$=1.3 mW. The maximum power consumption on the columns will be 48 mW/$30^2\times15^2$=12 mW.

The total power consumption for the color sequential addressing drive 900, 905 (of FIGS. 9A-9B), $P_{QVGA\text{-}prop}$ is therefore at least 1.3 mW and at most 13.3 mW, which is almost a factor 4 lower than the total power consumption for conventional drive scheme 800, 805 (of FIGS. 8A-8B) of at least 3.8 mW and at most 51.8 mW. The image update time is at most twice as long, resulting in energy consumption per image update that is more than a factor 2 lower.

Figure 10A:
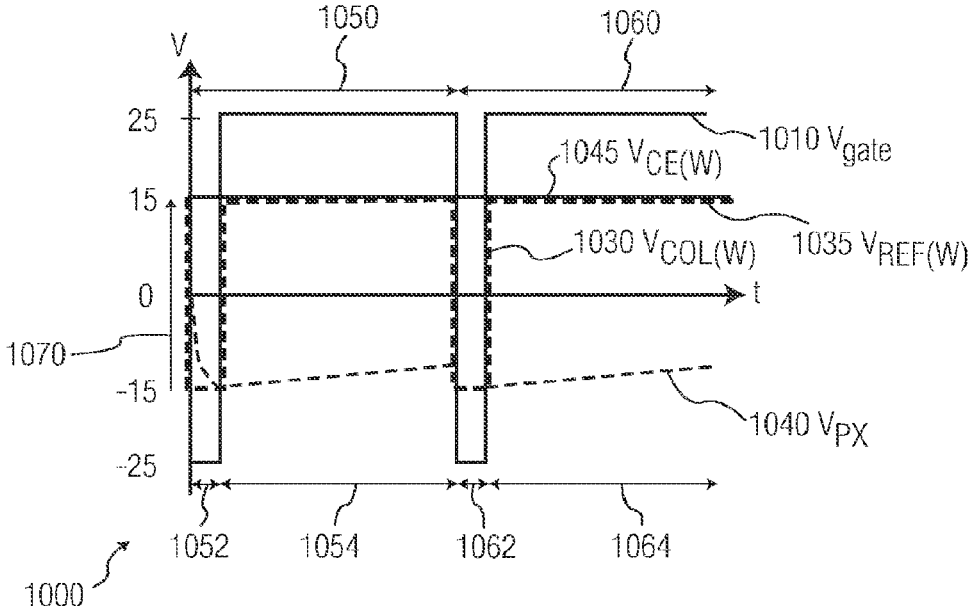
FIGS. 10A-10B show waveforms for two frames using color sequential active-matrix drive scheme with reduced image update time according to a further embodiment.
Figure 10B:
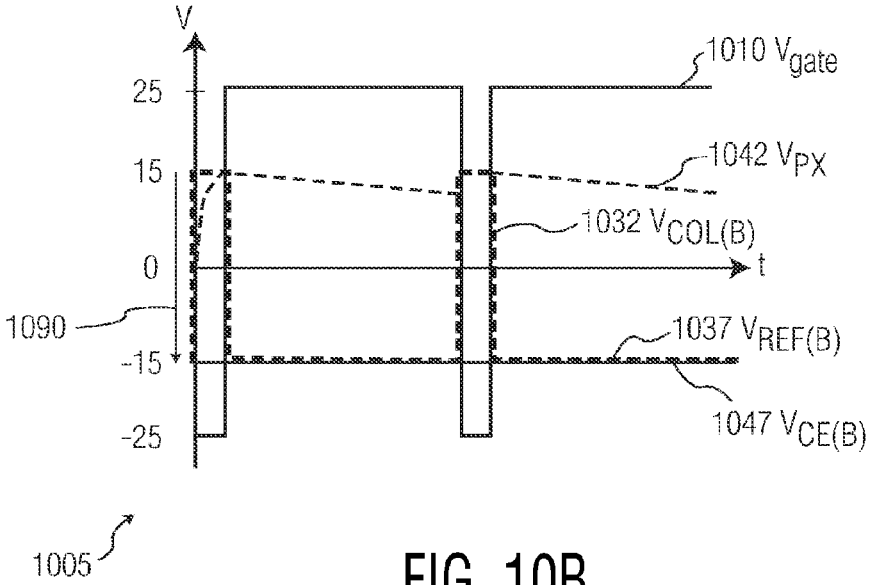

A further embodiment includes color sequential update with reduced image update time as shown in FIGS. 10X-10B. In particular, FIGS. 10A-10B show voltage levels of the signals versus time for two frames 1050, 1060 using a color sequential active-matrix drive scheme (e.g., scheme 1000 for driving a pixel to white and scheme 1005 for driving a pixel to black) with reduced image update time according to another embodiment of the present display and drive scheme. The solid curve 1010 shows the voltage on one row $V_{row}$ (or $V_{gate}$). The dotted curves 1030, 1032 are the voltage on a column $V_{col}$. The dashed curves 1040, 1042 are the voltage of a pixel $V_{px}$ applied at node P to a pixel ($C_{DE}$ in FIG. 5A) that is attached to the row and the column. The solid line 1045 at 15V in FIG. 10A and solid line 1047 at −15V in FIG. 10B show the common electrode voltage $V_{CE}$.

The pixel voltage $V_{px}$ starts at 0V before the first frame 1050, while it is close to the required pixel voltage at the start of the second frame 1060. In this embodiment, the column voltage $V_{col}$ is equal to the common electrode voltage $V_{CE}$ when a pixel is not switched, e.g., $V_{col}=V_{CE}$=+15V for the white pixel drive 1000 shown in FIG. 10A, and $V_{col}=V_{CE}$=−15V for forming a black pixel drive 1005 shown in FIG. 10B. Thus, the effective pixel voltage $V_{pxeff}$, or the pixel voltage $V_{Eink}$ across the pixel $C_{DE}$ shown in FIG. 5A, is ±30V during the addressing phase or time periods 1052, 1062, and 0V during the non-addressing time periods 1054, 1064 when the pixel $C_{DE}$ is not switched. However, when not in the relevant time period 1062 (see FIG. 10A)—during the conducting phase of the TFT, the column voltage can be any voltage, in particular, column data for other rows may be put on the column electrode.

The pulses shown in FIGS. 10A-10B are pulses as applied in a polymer electronics active-matrix back plane with p-type TFTs. For n-type TFTs (e.g. amorphous silicon) the polarity of the row pulses and the common electrode voltage are inverted. In FIG. 10A, the pixel is charged to a pixel voltage $V_{px}$ 1040 of −15V (e.g. a white pixel), while the common electrode voltage $V_{CE}$ is set to +15V. The reference voltage $V_{ref}$ 1035 (of $V_{col}$ e.g., as described in connection with FIG. 7) is +15V for pixels that are not switched during this addressing phase. In FIG. 10B, the pixel is charged to a pixel voltage $V_{px}$ 1042 of +15V (e.g. a black pixel), while the voltage $V_{CE}$ applied to the common electrode (170 shown in FIGS. 1 and 3-5) is set to −15V. The reference voltage $V_{ref}$ 1037 is −15V for pixels that are not switched during this addressing phase.

When the addressing scheme 700 of FIG. 7 is used, it is possible to reduce the total image update time as compared to the conventional addressing scheme 800, 805 (shown in FIGS. 8A-8B) without a commensurate increase in drive voltages (e.g., without increasing $V_{col}$ and $V_{row}$) by using the addressing schemes 1000, 1005 of FIGS. 10A-10B, where the same voltage levels for $V_{col}$, $V_{row}$ and $V_{px}$ as the conventional addressing scheme 800, 805 of FIG. 8A-8B are used, except that the common electrode voltage $V_{CE}$ is changed from 0 in FIGS. 8A-8B to in ±15V FIG. 10A-10B (namely, $V_{CE}$=+15V in FIG. 10A, and $V_{CE}$=−15V in FIG. 10B). This results in twice the pixel voltage $V_{Eink}$ across the pixel $C_{DE}$±30V in FIGS. 10A-10B as shown by reference numeral 1070, 1090, as compared to ±15V in FIGS. 8A-8B as shown by reference numeral 870, 890. The increased $V_{Eink}$ in FIGS. 10A-10B increases the image update speed (i.e., decreases the image update time) without commensurate increase in power consumption as compared to the conventional addressing scheme 800, 805 of FIGS. 8A-8B) since the voltage levels for $V_{col}$, $V_{row}$ and $V_{px}$ are the same in both FIGS. 10A-10B and FIGS. 8A-8B.

For flexible, polymer electronics displays, for example, such a color sequential update (FIGS. 10A-10B) also increases the lifetime of the integrated row drivers, due to reduction of the duty cycle, e.g., addressing or ON-time 1090 of the TFTs (i.e. the fraction of time that the drivers are operational). Reduced duty cycle is possible without detrimental impact due to the faster image update (or reduced image update time). This is also the case for the drive schemes shown in FIGS. 9A-9C for reasons of reduced voltage swing.

By comparison to the conventional addressing schemes 800, 805 shown in FIGS. 8A-8B where a single, e.g., zero, level for $V_{CE}$ is used, the color sequential update schemes 1000, 1005 with reduced image update time shown in FIGS. 10A-10B, includes changing or varying the common voltage $V_{CE}$, such as between positive and negative values such as ±15V. This increases the voltage swing or $V_{Eink}$ across the pixel $C_{DE}$ from ±15V to ±30V. Thus, by choosing different levels for the common electrode voltage $V_{CE}$ for the two drive phases 1000, 1005, e.g., +15V during the 'white' phase and −15V during the 'black' phase, it is possible to address the display with a pixel voltage of $V_{Eink}$=±30V, which is twice the ±15V the pixel voltage used in the conventional addressing schemes 800, 805 shown in FIGS. 8A-8B.

It should also be noted that, with the color sequential update scheme with the reduced image update time shown in FIGS. 10A-10B, where $V_{Eink}$=±30V (as seen from reference numerals 1070, 1090), which is twice the ±15V level (870, 890 in FIGS. 8A-8B) used in the conventional drive schemes 800, 805 of FIGS. 8A-8B, the required column voltages are identical, e.g., $V_{col}$=±25V in both schemes shown in FIGS. 8A-8B and 10A-10B.

Due to the increased $V_{Eink}$ from ±15V (870, 890 in FIGS. 8A-8B) to ±30V (1070, 1090 in FIGS. 10A-10B), the total image update time will be shorter, as can be seen in FIG. 2. For example, as shown in FIG. 2, the switching time is approximately 230 ms at 20V; and the switching time is approximately 600 ms at 10V. This results in a total image update of approximately 460 ms (e.g. 2×230 ms) with the color sequential update drive schemes 1000, 1005 shown in FIGS. 10A-10B, as compared to 600 ms with the conventional drive scheme shown in FIGS. 8A-8B. The energy consumption per image update will be lower, as the image update time is approximately 25% smaller (i.e., reduced by 140 ms (140/600=23.33%) from 600 ms to 460 ms).

A further embodiment includes a drive scheme for color sequential update with improved image uniformity, where the embodiment associated with FIGS. 9A-9B and 10A-10B are combined in order to increase the image uniformity. Image non-uniformity is especially a problem for flexible, polymer electronics active-matrix E-ink displays, where charging of the pixels towards the negative voltage (i.e. white) is often incomplete. The incomplete negative pixel charging results in non-uniform images, due to the non-uniformities of the pixel TFTs. The uniformity of images may be improved by charging the pixels with a larger negative row (or gate) voltage $V_{row}$, as the current running through the TFT is dependent on the voltage difference between the row voltage and the minimum of the column (or source) and pixel (or drain) voltages. To further image uniformity, the voltage difference may also be increased between the non-select row voltage and the highest pixel voltage, particularly in case of leakage through the TFT being the dominant factor in image non-uniformity.

Figure 11:
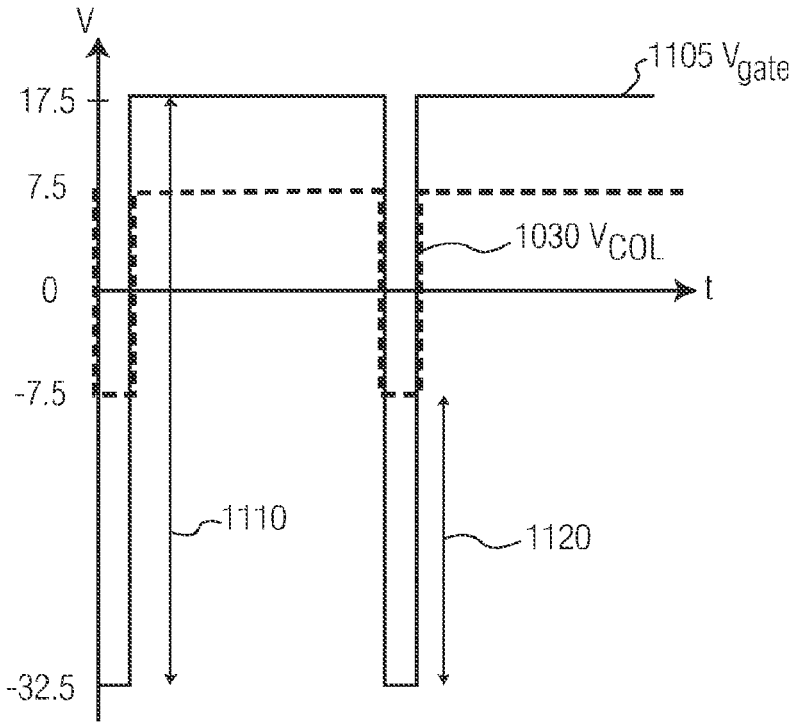
FIG. 11 shows waveforms using color sequential active-matrix drive scheme with increased image uniformity according to yet a further embodiment.

When using the addressing scheme shown in FIG. 9A-9B, the voltage swing of $V_{row}$ on the rows or TFT gates is reduced by 15 V. That is, the 50V (or ±25V) swing of $V_{gate}$ (or $V_{row}$) of FIGS. 8A-8B is reduced by 15V to 35V (or ±17.5V FIG. 9A-9B). Instead of applying $V_{gate}$ of ±17.5V, as shown in FIG. 9A-9B, the negative level of the row or gate voltage $V_{gate}$ $V_{row}$ 1105 may be further decreased from −17.5V to −32.5V as shown in FIG. 11, thus resulting in a voltage swing from +17.5V to −32.5V of 50V, shown as arrow 1110 in FIG. 11. That is, the 50V voltage swing 1110 (between +17.5V to −32.5V) on the rows is identical to that of the conventional drive scheme shown in FIGS. 8A-8B as reference numeral 895. However, the row select-voltage of −32.5 in FIG. 11 is 25V lower (reference numeral 1120 in FIG. 11) than the column voltage $V_{col}$ 1130 and the pixel voltage of −7.5V, while row select-voltage of −25 in FIG. 8A is only 10V (i.e., −15−(−25)) lower than the column and the pixel voltages of −15V in the conventional drive scheme shown as reference numeral 897 in FIG. 8A. The larger difference between the row select-voltage on one hand, and the column and the pixel voltages on the other hand, (i.e., 25V shown as reference numeral 1120 of FIG. 11 versus 10V shown as reference numeral 897 of FIG. 8A) increases the TFT current and thus the charging ratio of the pixels and, as a result, the uniformity will therefore be increased.

A further drive scheme embodiment is related to the timing of switching the voltage on the common electrode, i.e., timing of switching or changing $V_{CE}$. In order to avoid image artifacts, the common electrode is switched when all the rows are non-selected. Alternatively the Vce and Vst are switched at substantially the same time: (1) when no rows are selected; or (2) at the start of any row selection time; or (3) during a row selection time after which the selected row gets at least a full row selection period to charge the pixels to the column voltage level. In particular, preferably the switch of the Vce and the Vst does not result in one or more pixels being charged to an incorrect voltage (i.e. another voltage than the column voltage). If a row is selected, this row will have a different behavior as compared to all other non-selected rows. After the common electrode is switched or changed, the voltage over the pixels will change. This will lead to image artifacts as well. To avoid such image artifacts, the common electrode voltage $V_{CE}$ is changed when all rows are non-selected. In other words, the gate voltage ($V_{gate}$ or $V_{row}$) of all the rows should be kept high (i.e., non-selected-TFTs non-conducting) while changing the common electrode voltage. The column voltage $V_{col}$ is irrelevant at this moment because all TFTs are switched off (i.e., non-conducting).

The proper timing of voltage changes may be achieved in the configuration with a separate storage capacitor line 340 (shown in FIGS. 3 and 5), by changing the storage capacitor voltage at substantially the same time and with voltage swing corresponding to the voltage of the common electrode 170, as shown in FIG. 5B during switch period 594. As the storage capacitor $C_{st}$ is approximately at least twenty times larger than all other capacitors in the pixel, the voltage $V_{Eink}$ across the pixel $C_{DE}$ will keep substantially the same value when both the storage capacitor line 340 and the common electrode 170 are switched at substantially the same time.

The various embodiments offer certain advantages, such as lowering the column-data-drain voltages with a factor 2 (e.g., from 15V to 7.5V) and/or lowering the row or gate voltages accordingly during addressing of a bi-stable (e.g., electrophoretic) display without losing the ability to generate grey levels. This makes it possible to use a larger range of commercially available drivers. A further advantage includes decreasing the image update time of the display. In addition, the uniformity of flexible, polymer electronics E-ink displays may be increased, because the voltage difference between the rows and the columns is increased when the column voltage is reduced.

Of course, it is to be appreciated that any one of the above embodiments or processes may be combined with one or with one or more other embodiments or processes to provide even further improvements in finding and matching users with particular personalities, and providing relevant recommendations.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same or different item(s) or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise; and h) no specific sequence of acts or steps is intended to be required unless specifically indicated.

What is claimed is:

1. A display device comprising:

a row driver configured to provide a row voltage;

a row electrode connected to the row driver;

a column driver configured to provide a column voltage to a first terminal of a pixel;

a column electrode connected to the column driver;

a common driver configured to provide a positive common voltage level to a second terminal of the pixel for a first state of the pixel and a negative common voltage level for a second state of the pixel;

a common electrode connected to the common driver; and a storage capacitor connected between a capacitor line and the first terminal of the pixel, wherein the capacitor line is connected to a storage driver for providing the storage voltage to the storage capacitor, the storage driver being connected to the common driver for providing a voltage proportional to the common voltage level as the storage voltage.

2. The display of claim 1, wherein the first state includes one of a white state and a black state of the pixel, and the second state includes another of the white state and black state of the pixel.

3. The display of claim 1, wherein the column voltage has positive and negative values.

4. The display of claim 1, wherein at least one of the column driver and the common driver is configured to decrease an image update time by increasing a voltage across the pixel.

5. The display of claim 1, wherein the row driver is configured to compensate for incomplete charging of a pixel by reducing a negative level of the row voltage.

6. The display device of claim 1, further comprising a controller configured to switch the common electrode when all rows have a nonselect level of the row voltage, at the start of a row selection period, or during a row selection period.

7. A display device comprising:

a row driver configured to provide a row voltage;

a row electrode connected to the row driver;

a column driver configured to provide a column voltage to a first terminal of a pixel;

a column electrode connected to the column driver;

a common driver configured to provide a positive common voltage level to a second terminal of the pixel for a first state of the pixel and a negative common voltage level for a second state of the pixel;

a common electrode connected to the common driver; and a storage capacitor connected between a capacitor line and the first terminal of the pixel, wherein the storage voltage is related to the common voltage by a ratio of a storage capacitance value of the storage capacitor and a total capacitance of the pixel.

8. The display device of claim 7, wherein the first state includes one of a white state and a black state of the pixel, and the second state includes another of the white state and black state of the pixel.

9. The display device of claim 7, wherein the column voltage has positive and negative values.

10. The display device of claim 7, wherein at least one of the column driver and the common driver is configured to decrease an image update time by increasing a voltage across the pixel.

11. The display device of claim 7, wherein the row driver is configured to compensate for incomplete charging of a pixel by reducing a negative level of the row voltage.

12. The display device of claim 7, further comprising a controller configured to switch the common electrode when all rows have a nonselect level of the row voltage, at the start of a row selection period, or during a row selection period.

* * * * *